US006058840A

United States Patent [19]

Poplawski et al.

[11] Patent Number: 6,058,840

[45] Date of Patent: May 9, 2000

[54] STAMP MOUNTING

[75] Inventors: Lucjan Poplawski; Krzysztof Poplawski, both of Warszawa, Poland

[73] Assignee: Zaklad Mechaniczny "WAGRAF", Warszaw, Poland

[21] Appl. No.: 09/091,383

[22] PCT Filed: Feb. 21, 1996

[86] PCT No.: PCT/NL96/00084

§ 371 Date: Jun. 17, 1998

§ 102(e) Date: Jun. 17, 1998

[87] PCT Pub. No.: WO97/22478

PCT Pub. Date: Jun. 26, 1997

[30] Foreign Application Priority Data

Dec. 18, 1995 [PL] Poland ..... 311908

[51] Int. Cl.[7] ..... B41K 1/56

[52] U.S. Cl. ..... 101/405; 101/333

[58] Field of Search ..... 101/405, 333, 101/334

[56] References Cited

U.S. PATENT DOCUMENTS

| | | | |
|---|---|---|---|
| 5,111,745 | 5/1992 | Wilson | 101/333 |
| 5,174,208 | 12/1992 | Fink | 101/333 |
| 5,377,599 | 1/1995 | Wall et al. | 101/333 |
| 5,595,112 | 1/1997 | Seo | 101/333 |
| 5,694,844 | 12/1997 | Taira | 101/333 |

FOREIGN PATENT DOCUMENTS

| | | |
|---|---|---|
| 0 438 067 A2 | 7/1991 | European Pat. Off. . |
| 60-162684 | 8/1985 | Japan . |
| 2 226 276 | 6/1990 | United Kingdom . |
| 88/01943 | 3/1988 | WIPO . |

*Primary Examiner*—John S. Hilten
*Assistant Examiner*—Darius N. Cone
*Attorney, Agent, or Firm*—Heller, Ehrman, White & McAuliffe, L.L.P.

[57] ABSTRACT

A mounting for a manual stamp has an outer casing, a stamp-carrying body that is slidably mounted in the outer casing against a spring loading force, and a protective cover. One of the stamp-carrying body and the cover has a resilient tongue, and the other has a locking member engageable with the tongue. When the cover is placed on the stamp-carrying body, the latter can be pushed into a retracted position within the outer casing and be locked in that position by latching of the tongue with the locking member.

12 Claims, 1 Drawing Sheet

STAMP MOUNTING

Figure 1:
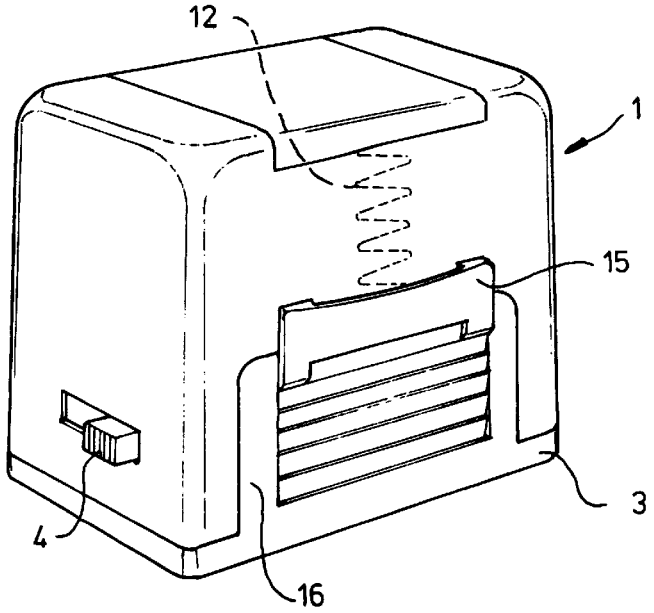

The invention relates to a mounting for manual stamps comprising an outer casing, a stamp-carrying body which is slidably mounted in the outer casing and which comprises a lower peripheral edge, and at least one spring pushing the stamp-carrying body out of the outer casing.

A stamp mounting is known from European Patent Application Publication No. 0 438 067 A2, in which the outer casing is made to slide over the stamp-carrying body, causing the actuation of a mechanism for rotating the punch, the performance of the action of stamping and the return to a position in contact with the ink pad.

In the working position, the punch which carries the stamp is rotated inside the stamp-carrying body to face inwardly with respect to the open end of the stamp-carrying body, and is held against an ink cushion. By pressing down upon the outer casing, the outer casing slides across the stamp-carrying body bringing the punch downwards and simultaneously rotating it such that the wetted stamp rubber faces outwardly. When the outer casing is completely pressed down, a stamp is formed on a receiving surface, such as a sheet of paper. Upon release of the pressure on the outer casing, the spring forces will push back the outer casing such that the stamp-carrying body again projects from the outer casing, and the punch is again rotated inwardly and is seated against the ink pad.

Both in a rotating position or a position for transport with the stamp-carrying body of the mounting extended downwards, and in the working position, when the outer casing of the mounting is slid onto the lower stamp-carrying body, access to the mechanism for rotating, stamping and wetting is open from below and constitutes a possibility of contamination of the interior. When a mechanism for locking the stamp-carrying body in a retracted position in the outer casing is provided, the stamp rubber is turned to the outside, such that there is a possibility that in this case the ink will soil hands and places where the stamp is being kept when not in use.

There is also a known stamp mounting which additionally has a cover with a clip, while on the narrow side of the outer casing there is locking pawl which is movable transversely to the narrow side, and on the lower stamp-carrying body there is a catch, in guides, for the locking pawl. The transversely movable locking pawl is used to lock the stamp-carrying body in a retracted position, which corresponds to the outwardly turned position of the punch wherein the surface intended for the rubber is turned outwards. Such locking of the position of the punch allows the punch rubber to be adhesively bonded on when the stamp is being assembled.

However, placing the stamp mounting in a working position requires the locking pawl to be unlocked and the stamp-carrying body to protrude from its retracted position.

In the retracted position of the stamp-carrying body the stamp rubber is pressed against the ink pad after having been rotated through 180° with respect to the position in which the stamp-carrying body is extended from the outer casing. Various covers can be applied to screen the stamp of the stamp-carrying body from the open side, both when the locking pawl is locked and after the locking pawl has been unlocked. This, however, results in additional actions being necessary, and the covers form an additional component which is not functionally related to the stamp mounting.

The objective of the invention is to develop a stamp mounting structure which makes it possible to keep the stamp in a position with the rubber protruding in the forward direction, and thus in a position in which the stamp-carrying body is retracted into the outer casing without the need to apply and use a locking pawl and a catch in guides.

Furthermore, it is an object of the present invention to provide a cover for a mounting for a stamp which can be easily put in place, and which after removal leaves the stamp in a ready-for-use position.

Thereto the invention is characterized by a cover comprising a receiving surface for abutting against the lower peripheral edge of the stamp-carrying body, a resilient tongue being provided on the cover or on the outer casing, and a locking member being provided on the outer casing or the cover, which tongue and locking member engage upon pushing the stamp-carrying body back against the spring loading force and keep the stamp-carrying body in its retracted position upon locking.

Normally, after use the stamp-carrying body will be pushed out of the outer casing by the springs. In this position, the stamp is facing towards the interior of the stamp-carrying body and is pressed into contact with an internal stamp pad. In this position the cover according to the invention can be placed in abutting contact with the lower peripheral edge of the stamp-carrying body. By simply pressing down on the cover using one hand, the stamp-carrying body is pressed into the outer casing against the spring loading force until the cover latches into locking engagement with the side walls of the outer casing. In this way, the stamp-carrying body is kept in its retracted position by the locking member and the resilient tongue, such that the stamp is ready for transport and can be carried into the pocket of an user without the risk of contamination. When the stamp is to be used, the resilient tongue and the locking member on the outside of the stamp, can be disengaged. As a result, the stamp-carrying body is pushed outwardly by the springs and pushes the cover downwards. The cover can then easily be removed and the stamp is ready for use.

In a preferred embodiment according to the invention, the resilient tongue is attached to the cover and extends parallel to a side face of the outer casing. Preferably, the cover comprises two opposing side walls which extend transversally to the receiving surface parallel to the side faces of the outer casing. In this construction, the side faces of the stamp-carrying body can first be easily placed between the side walls of the cover. Then the cover is pressed upwards into its locked position.

In a further preferred embodiment according to the invention, one of the side walls of the cover carries the resilient tongue. The side face of the outer casing which is parallel to the resilient tongue preferably comprises a cut-out portion for receiving the side wall of the cover when the stamp carrying body is pushed back into its retracted position. In this way, a part of the outer casing is in the closed position is formed by the side walls of the cover. This construction saves on materials and provides for a relatively light stamp, with an attractive appearance.

In a further preferred embodiment of a mounting according to the invention, the resilient tongue comprises an inwardly bevelled edge which stands away from the tongue in the direction of the receiving surface. The locking member comprises a rim for latching behind the bevelled edge. With this simple construction, a efficient locking of the stamp-carrying body in its retracted position can be achieved. By simply lifting the resilient tongue slightly, the rim is disengaged from the bevelled edge and the stamp-carrying body is pushed outwardly.

Figure 2:
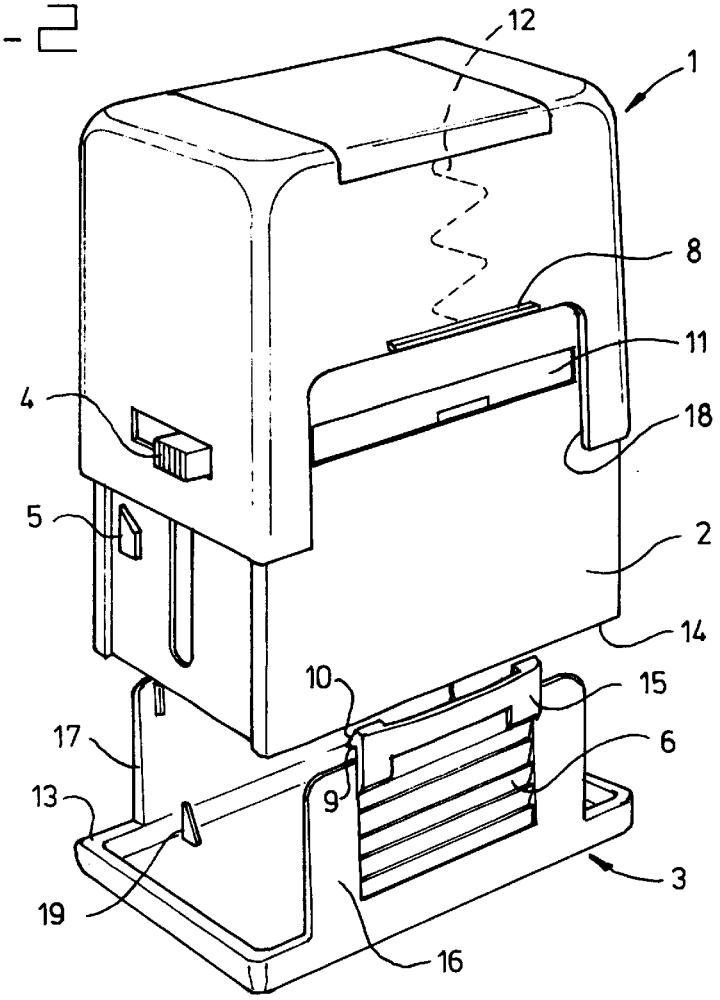

An embodiment of a mounting according to the invention is illustrated in the accompanying drawing, in which FIG. 1 shows a perspective view of the complete stamp mounting in a storage position, wherein a cover has been engaged with the outer casing and FIG. 2 shows a perspective view of the stamp mounting of FIG. 1 with the stamp-carrying body protruding wherein the cover has been disengaged, An embodiment of the stamp mounting according to the invention consists of an outer casing 1 which slides onto a lower stamp-carrying body 2, a cover 3, and of inner parts constituting a mechanism for rotating a punch rubber and wetting it in an ink pad 11. The ink pad 11 can be removed from the stamp mounting for replacement or refilling in a direction perpendicular to the plane of the sidewalls of the stamp-carrying body 2. The punch rubber is located below the ink pad 11, inside the stamp-carrying body 2, and is not shown in the figures.

The outer casing 1 is used for applying pressure to a known mechanism for simultaneously pressing down and rotating the stamp 11. In the extended position of the stamp-carrying body 2 as shown in FIG. 2, the punch rubber faces upwards and contacts the ink pad 11 at the top of the stamp-carrying body 2. The stamp-carrying body is pressed outwardly from the outer casing 1 by springs 12 and is guided on guides with catches 5, shown in FIG. 2. On the narrow side of the outer casing there is a locking pawl 4 movable transversely to the narrow side and used to lock the position of the outer casing 1 in relation to the stamp-carrying body 2 in a position in which the punch rubber is moved away from the ink-saturated pad 11 for exchanging the punch rubber or for adhesively bonding a punch rubber prior to first time use of the stamp mounting.

However, the locking pawl 4 is not used after the punch rubber has been adhesively attached to the punch, and is not essential to the present invention. If desired, the locking pawl 4 may be omitted.

The cover 3 comprises a receiving surface 13 which can abut against the lower peripheral edge 14 of the stamp-carrying body 2. Transversely to the receiving surface 13 of the cover 3, two walls 16 and 17 extend upwardly. In FIG. 2, the forward wall 16 carries a resilient tongue 15. A locking member 8, in the form of a rim is provided on the outer casing 1. When pressing the cover 3 upwardly against the lower peripheral edge 14 of the stamp-carrying body 2, this stamp-carrying body can be pressed upwardly against the spring loading forces of springs 12 into the outer casing 1 until the resilient tongue 15 latches behind the rim 8. This will result in a closed transport position as shown in FIG. 1. In this closed transport position, the punch rubber faces the cover 3 and is turned away from the ink pad 11. The sides of the removable ink pad 11 are in the transport position covered by the walls 16 and 17 of the cover, such that it cannot be removed from the stamp-carrying body by accident and in this way cause unwanted contamination.

As can be seen in FIG. 2, the clip 3 has on one side a small pocket 9 below a bevelled edge 10 for engaging with the rim 8 situated laterally on the outer casing 1. Sliding the cover 3 onto the stamp-carrying part 2, overcoming the resistance of the springs 12, causes it to slide into the outer casing 1, and causes the snap locking of the levelled edge 10 and rim 8 which fixes the position both of the outer casing 1 and the stamp-carrying body 2 in a retracted position which is convenient for storing the stamp mounting.

The small pocket 9 is located below the inward bevelled edge 10 forming a deviation from the lateral plane of the outer casing 1. Sliding the side of the small pocket 9 together with the bevelled edge 10 from the rim 8 results in the stamp-carrying body 2 being unlocked from the outer casing 1 and its protrusion under the effect of the action of springs 12 of the inner mechanism. By virtue of a simple movement of retraction of the resilient tongue 3 which slides onto the stamp-carrying body 2, or, in a second operation, by virtue of a simple movement of moving away the small pocket 9, closing is obtained with a simultaneous decrease in the dimensions of the stamp mounting, or opening is obtained with simultaneous wetting of the punch rubber in the ink. Corrugations 6 are used for easy operation of the cover 3. Such a structural solution facilitates the operation of the small cover 3, as a result of which it becomes functional and does not interfere with the utilization of the stamp.

As can be seen from FIG. 2, the lower parts 18 of the side faces of the outer casing are removed. In this way, the side walls 16, 17 of the cover 3 fit into these cut-out portions such that in the closed position, as shown in FIG. 1, the side walls 16 and 17 are flush with the side faces of the outer casing 1.

In the embodiment shown in FIGS. 1 and 2, the resilient tongue 15 is located on the cover 3, whereas the rim 8 may be located on the outer casing. It will be clear to the person skilled in the art, that in alternative embodiments, the resilient tongue 15 can also be located on the outer casing, whereas the rim 8 is located on the cover 3. Furthermore it should be understood that the term "resilient tongue" is intended to mean any pawl, latch, tab, or similar element that has a certain amount of elasticity such that it can be displaced through a small distance and elastically return to its original position. Furthermore it is clear that the latch mechanism formed by catch 5 and locking pawl 4 is an optional feature which may be omitted if desired and does not form a limitation to the present invention.

In a further embodiment, guide pins 19 as shown in FIG. 2 may be placed on the bottom of the cover 3, for slipping behind the walls of the stamp-carrying body 2 near the lower peripheral edge 14. In this way an upper positioning of the cover 3 onto the lower peripheral edge 14 is possible.

What is claimed is:

1. A mounting for a manual stamp comprising:

an outer casing, a stamp-carrying body which is slidably mounted in the outer casing and which comprises a lower peripheral edge, at least one spring pushing the stamp-carrying body out of the outer casing, a cover comprising a receiving surface for abutting against the lower peripheral edge of the stamp-carrying body, a resilient tongue provided on one of the cover or the outer casing, and a locking member provided on the other of the cover or the outer casing, the tongue and the locking member engaging upon pushing the cover and the stamp-carrying body back against the spring and keeping the stamp-carrying body in a retracted position upon engagement.

2. The mounting of claim 1 wherein the resilient tongue comprises an inwardly beveled edge which stands away from the tongue in the direction of the receiving surface and the locking member comprises a rim for latching behind the beveled edge.

3. The mounting of claim 1 wherein the cover comprises two opposing side walls which extend transversely to the receiving surface parallel to the side faces of the outer casing.

4. The mounting of claim 3 wherein the resilient tongue comprises an inwardly beveled edge which stands away from the tongue in the direction of the receiving surface and the locking member comprises a rim for latching behind the beveled edge.

5. The mounting of claim 3 wherein the resilient tongue is provided on one of the side walls of the cover, and the side face of the outer casing which is parallel to the resilient tongue comprises a cut-out portion for receiving the side wall of the cover when the stamp-carrying body is in the retracted position.

6. The mounting of claim 5 wherein the resilient tongue comprises an inwardly beveled edge which stands away from the tongue in the direction of the receiving surface and the locking member comprises a rim for latching behind the beveled edge.

7. The mounting of claim 1 wherein the resilient tongue is provided on the cover and extends parallel to a side face of the outer casing.

8. The mounting of claim 7 wherein the resilient tongue comprises an inwardly beveled edge which stands away from the tongue in the direction of the receiving surface and the locking member comprises a rim for latching behind the beveled edge.

9. The mounting of claim 7 wherein the cover comprises two opposing side walls which extend transversely to the receiving surface parallel to the side faces of the outer casing.

10. The mounting of claim 9 wherein the resilient tongue comprises an inwardly beveled edge which stands away from the tongue in the direction of the receiving surface and the locking member comprises a rim for latching behind the beveled edge.

11. The mounting of claim 9 wherein the resilient tongue is provided on one of the side walls of the cover, and the side face of the outer casing which is parallel to the resilient tongue comprises a cut-out portion for receiving the side wall of the cover when the stamp-carrying body is in the retracted position.

12. The mounting of claim 11 wherein the resilient tongue comprises an inwardly beveled edge which stands away from the tongue in the direction of the receiving surface and the locking member comprises a rim for latching behind the beveled edge.

* * * * *